US005156252A

United States Patent [19]

Mello et al.

[11] Patent Number: 5,156,252

[45] Date of Patent: Oct. 20, 1992

[54] HANDRAIL GUARD HOUSING SHIELD

[75] Inventors: Ary O. Mello, Newington; Gerald E. Johnson, Farmington, both of Conn.; Arthur McClement, Bloomington, Ind.

[73] Assignee: Otis Elevator Company, Farmington, Conn.

[21] Appl. No.: 837,741

[22] Filed: Feb. 17, 1992

[51] Int. Cl.[5] ..... B66B 23/22

[52] U.S. Cl. ..... 198/338

[58] Field of Search ..... 198/323, 338

[56] References Cited

U.S. PATENT DOCUMENTS

| | | | |
|---|---|---|---|
| D. 318,357 | 7/1991 | Adrian et al. | D34/28 |
| 2,113,173 | 4/1938 | Dunn et al. | 198/338 |
| 2,550,918 | 5/1951 | Felix et al. | 198/338 |
| 2,846,045 | 8/1958 | Fowler | 198/338 |
| 3,670,862 | 6/1972 | Kito | 198/338 |
| 3,809,206 | 5/1974 | Bredehorn et al. | 198/338 |
| 3,835,977 | 9/1974 | Hewitt et al. | 198/338 |
| 3,970,187 | 7/1976 | Esaki et al. | 198/338 |
| 4,619,355 | 10/1986 | Adrian et al. | 198/338 |
| 4,976,345 | 12/1990 | Adrian et al. | 198/338 |
| 5,064,047 | 11/1991 | Moldenhauer et al. | 198/338 |
| 5,117,968 | 6/1992 | Rivera | 198/338 |

*Primary Examiner*—Joseph E. Valenza

*Attorney, Agent, or Firm*—William W. Jones

[57] ABSTRACT

The handrail reentry guard housing on a moving walkway or an escalator is provided with a retrofittable shield which is attached to the underside of the guard housing, and which fills the space between the moving handrail and the guard housing. The shield is formed from complimentary halves which are made from formed plastic sheets. The shield halves are somewhat flexible so as not to form a rigid counterpart to the moving handrail. Hook and loop components are secured to the guard housing and to the shield halves to allow for retrofit securement of the shield to the guard housing.

3 Claims, 3 Drawing Sheets

HANDRAIL GUARD HOUSING SHIELD

DESCRIPTION

1. Technical Field

This invention relates to a safety device which is used on an escalator or moving walkway to limit the amount of entrapment space between the moving handrail and a handrail guard housing mounted beneath the escalator exit newels. More particularly, the invention involves the use of three-dimensional shields which are retrofittable onto the handrail reentry guard housing between the housing and the handrail.

2. Background Art

U.S. Pat. No. 318,357 granted Jul. 16, 1991 to W. Adrian, et al., discloses an escalator handrail reentry housing which is mounted beneath the escalator exit newels and which covers the handrail reentry ports in the escalator decks. This reentry housing includes a top portion which overlies the path of travel of the handrail and which projects away from the escalator decks in a direction counter to the direction of movement of the handrail. The housing prevents one from putting one's hand or some item of clothing in the deck reentry ports. The housings are built to last as long as the escalator and to that end are preferably made from a durable material, such as aluminum, or the like. Since the housing is formed from such a hard material, care must be taken to ensure that the handrail does not contact and abrade itself on the housing. Thus, a planned space is provided between the housing and the moving handrail. It would be desirable to substantially fill that space with a shield which is a three-dimensional article, and which would not damage the handrail should the latter occasionally contact the shield.

DISCLOSURE OF THE INVENTION

This invention relates to a shielding assembly for affixation to the reentry housing discussed above, which assembly can be mounted on the housing between the housing and the handrail. The shield assembly is preferably formed from a flexible plastic material such as Kydex brand polymethylmethacrylate PVC and includes two half components. Each of the components is generally trough-shaped, and has side walls which depend from a transverse wall that is positioned closely adjacent to the handrail when the shield is affixed to the housing. The end of each of the shield halves which first encounters the moving handrail is sloped so as to extend from the transverse wall toward the housing, thereby forming an acute angle with the handrail. The shield halves are secured to the housing with hook and loop fasteners preferably. Hook or loop components are adhered to the inner sides of the housing and their complementary hook or loop components are adhered to the outer surfaces of the shield half side walls, and to the inner surface of the shield half tapered wall. When in place, the shield substantially closes the gap between the handrail and housing, and provides a soft and compliant counterpart to the handrail which will not damage the handrail if the two contact each other.

It is therefore an object of this invention to provide a shielding assembly for use on a moving handrail reentry housing for closing a gap between the handrail and housing.

It is an additional object of this invention to provide a shielding assembly of the character described which can be retrofitted onto installed reentry housings in the field.

It is a further object of this invention to provide a shielding assembly of the character described which utilizes a relatively compliant shield that will not damage the handrail should contact therewith occur.

These and other objects and advantages of the invention will become more readily apparent from the following detailed description of a preferred embodiment thereof when taken in conjunction with the accompanying drawings, in which:

BEST MODE FOR CARRYING OUT THE INVENTION

Figure 1:
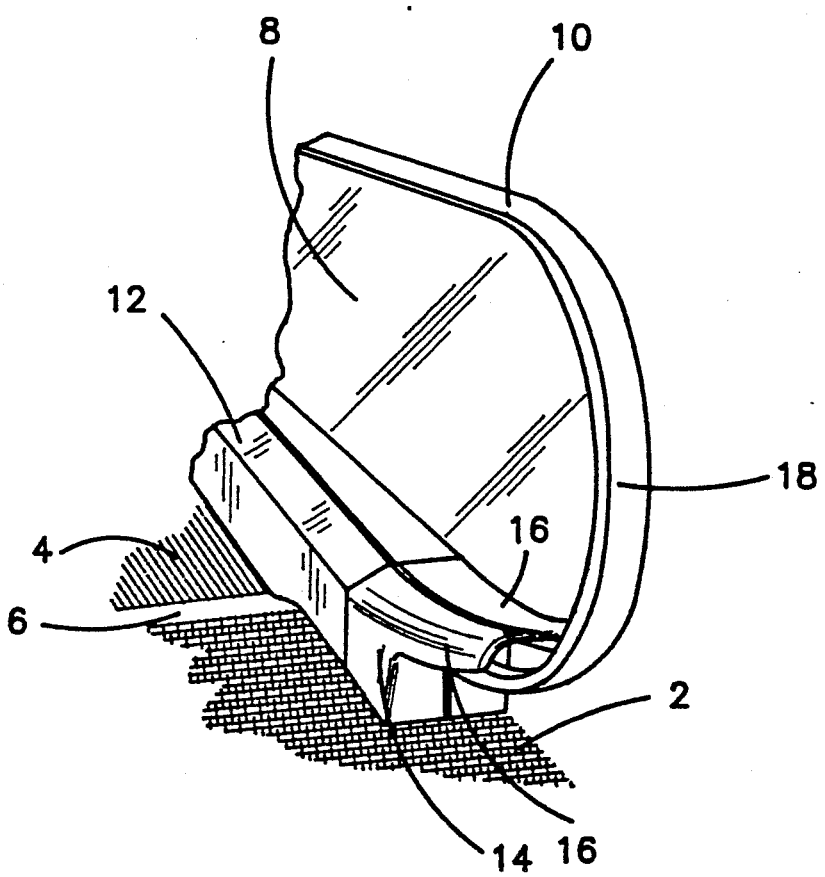
FIG. 1 is a fragmented perspective view of the exit newel portion of an escalator equipped with a handrail reentry housing.

Referring now to the drawings, the exit landing of an escalator is shown in FIG. 1. The escalator includes a landing plate 2 and a plurality of steps 4 which pass beneath a comb plate 6 adjacent to the landing 2. The steps 4 are flanked by a pair of balustrades 8 (only one of which is shown) on which moving handrails 10 are mounted. The balustrades 8 are mounted on decks 12 which are immediately adjacent to the steps 4, and beneath which the handrails 10 pass on their return path of travel. Handrail reentry housings 14 are mounted on one end of the decks 12. The housings 14 cover the reentry openings in the decks 12, and include projecting portions 16 beneath which the handrails pass as they leave the balustrade newels 18.

Figure 2:
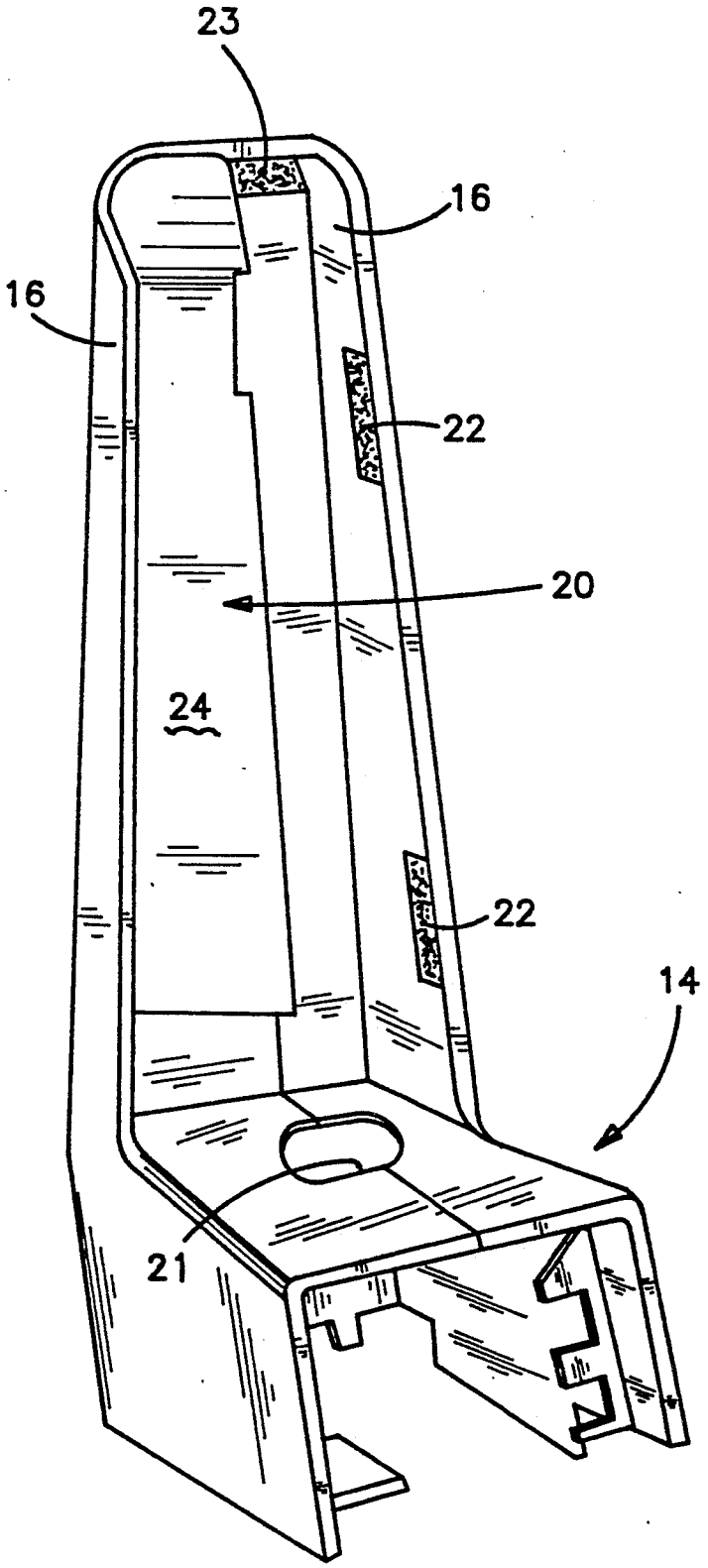
FIG. 2 is a perspective view of the reentry housing of FIG. 1 showing one of the shield halves affixed thereto.
Figure 3:
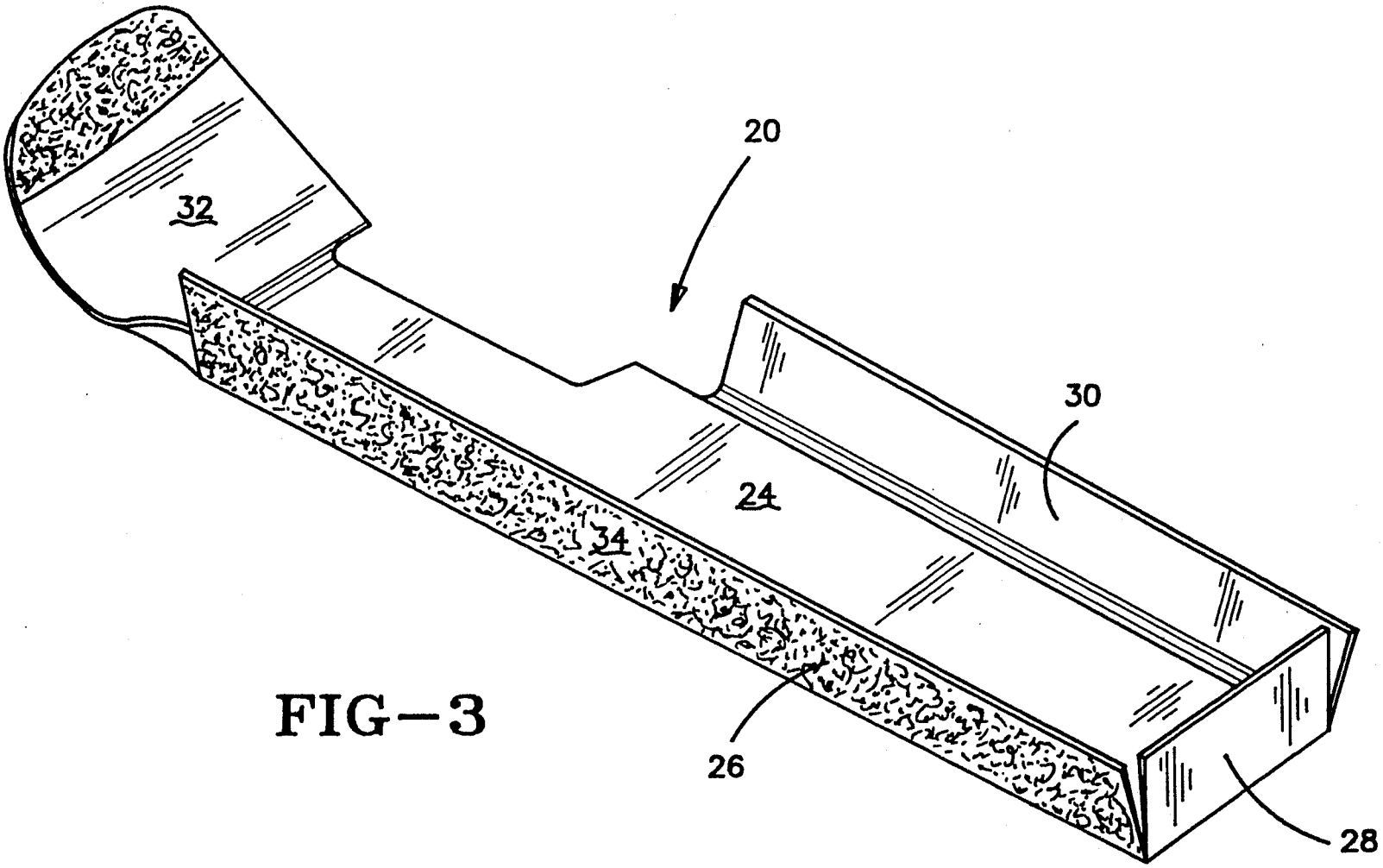
FIG. 3 is a perspective view of a shield half adapted for use in connection with this invention.

FIGS. 2 and 3 illustrate details of the flexible shields which are mounted beneath the projections 16 on the housings 14. FIG. 2 shows one of the shields 20 in place on the housing 14, and FIG. 3 shows details of a detached shield 20. It will be noted in FIG. 2 that the handrail reentry opening 21 is well protected from access by the projections 16. A plurality of hook and loop securement components 22 and 23 are adhered to the inner surface of the projection 16 adjacent to edges thereof. The shields 20 have a medial wall 24 which, when in place in the housing 14, are positioned closely adjacent to the handrail 10. There are three side walls 26, 28 and 30 which extend from the medial wall 24, and there is a fourth end wall 32 which tapers outwardly away from the medial wall 24. A strip 36 of hook and loop material covers the surface of the side wall 26 which faces the hook and loop components 22 on the housing 14, and a patch of hook and loop material 36 is adhered to the surface of the end wall 32 which faces the hook and loop component 23 on the housing 14. The shields 20 are affixed to the housing 14 by simply properly aligning them between the projections 16 and the handrail 10 and pressing the hook and loop components against their counterparts. The resulting assembly is quite tenacious, and the shields 20 are almost impossible to accidentally dislodge from the housing 14. They can be intentionally separated by passing a blade of a knife, screwdriver, or the like between the joined components.

The resulting assembly considerably narrows the gap between the housing and the moving handrail and thus provides some resistance to passage of objects between the handrail and the housing. Occasional contact between the handrail and the shields will not unduly harm the handrail since the underside of the handrail would be the area of contact, and since the shields do not possess significant abrasiveness. The shields can be easily retrofitted onto installed escalators and moving walkways in the field, and worn shields can be easily removed and replaced.

Since many changes and variations of the disclosed embodiment of this invention may be made without departing from the inventive concept, it is not intended to limit the invention otherwise than are required by the appended claims.

What is claimed is:

1. In combination with an escalator or moving walkway, a reentry guard assembly for a moving handrail for restricting access to a handrail reentry port at an exit landing of the escalator or walkway, said assembly comprising:

a) a rigid handrail guard disposed at said exit landing below a balustrade newel on the escalator or walkway, said guard being secured to a deck part of the escalator or walkway, and including elongated projection parts straddling the balustrade above the path of travel of the handrail, said projection parts being spaced apart from the handrail so as to be free of contact therewith and extending toward the newel;

b) a pair of shields, one disposed on each side of the balustrade, each of said shields being sandwiched between said projection parts and the handrail so as to lessen the space between said projection parts and the handrail; and c) releasable means connecting said shields with said projection parts, said releasable means allowing selective detachment of said shields from said projection parts whereby said shields can be periodically replaced.

2. The combination of claim 1 wherein said shields are formed from a resilient plastic material so as to allow occasional contact between the handrail and the shields without damaging the handrail.

3. The combination of claim 1 wherein said releasable means comprises hook and loop fastener elements adhered to said shields and to said projection parts.

* * * * *